US006444048B1

(12) United States Patent
Hasegawa et al.

(10) Patent No.: US 6,444,048 B1
(45) Date of Patent: Sep. 3, 2002

(54) ALLOY FOR USE IN PREPARATION OF R-T-B-BASED SINTERED MAGNET AND PROCESS FOR PREPARING R-T-B-BASED SINTERED MAGNET

(75) Inventors: Hiroshi Hasegawa; Yoichi Hirose, both of Saitama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/530,274

(22) PCT Filed: Aug. 28, 1998

(86) PCT No.: PCT/JP98/03840

§ 371 (c)(1),
(2), (4) Date: Jun. 19, 2000

(87) PCT Pub. No.: WO00/12771

PCT Pub. Date: Mar. 9, 2000

(51) Int. Cl.[7] ..... H01F 1/057

(52) U.S. Cl. ..... 148/101; 419/12; 148/302; 75/255

(58) Field of Search ..... 148/302, 101, 148/103; 420/83, 121; 419/12; 75/255

(56) References Cited

U.S. PATENT DOCUMENTS 5,595,608 A * 1/1997 Takebuchi et al. ..... 148/104
5,634,987 A * 6/1997 Zhang et al. ..... 148/302

FOREIGN PATENT DOCUMENTS

| | | | |
|---|---|---|---|
| JP | 5-21219 | | 1/1993 |
| JP | 06036916 | | 2/1994 |
| JP | WO 94/02950 | * | 2/1994 |
| JP | 09165601 | | 6/1997 |

* cited by examiner

*Primary Examiner*—John Sheehan
(74) *Attorney, Agent, or Firm*—Armstrong, Westerman & Hattori, LLP

(57) ABSTRACT

Processes for the preparation of a sintered alloy comprising $R_2Fe_{14}B$ as a magnetic phase constituting a main phase include a binary alloy process wherein a main phase alloy having a lower R content than the above phase is mixed with a grain boundary phase alloy rich in R component and serving as a liquid phase in the sintering in order to prepare a mixture to be used as the starting material. The conventional main phase alloy has a structure comprising the $R_2Fe_{14}B$ phase and, in addition, a large amount of an easily oxidizable lamella R-rich phase and a harmful dendrite α phase. On the other hand, the main phase alloy of the invention has a low dendrite a phase content and a low lamella R-rich phase and contains a lamella α Fe phase. This contributes to excellent oxidation resistance and improved properties of the magnet. The preparation of a sintered magnet by mixing the main phase alloy with the grain boundary phase alloy by the binary alloy method can reduce abnormal growth of crystal grains.

8 Claims, 2 Drawing Sheets

ALLOY FOR USE IN PREPARATION OF R-T-B-BASED SINTERED MAGNET AND PROCESS FOR PREPARING R-T-B-BASED SINTERED MAGNET

TECHNICAL FIELD

The present invention relates to an alloy used for producing a high-performance R—T—B sintered magnet and a method for producing the sintered magnet. More particularly, the present invention relates to a raw-material alloy, which is used for producing a high coercive-force R—T—B sintered magnet which is used, in turn, mainly for a motor or the like, and it relates to a method for producing such sintered alloy.

BACKGROUND TECHNIQUE

The R—T—B sintered magnet, in which R is at least one rare-earth element including Y, and T is Fe or a transition element, a part of which may be replaced with one of or both Co and Ni, is a representative high-performance magnet. The R—T—B sintered magnet is indispensable functional material, which supports miniaturizing, weight reducing and performance-enhancing of the magnet-utilizing parts. The R—T—B sintered magnet is applied in a broad field, such as electronics manufacture, various motors for OA, FA, diagnosis apparatuses for medical use and the like. Recently, the R—T—B sintered magnet is used in various motors for automobiles.

The R—T—B sintered magnet consists of a ferromagnetic. $R_2T_{14}B$ phase, on which the magnetism is based, R-rich-phase (the non-magnetic phase with high concentration of a rare-earth element such as Nd), and B-rich phase (the B-rich non-magnetic phase, for example, $Nd_{1.1}FeB_4$ phase in a case where R is Nd).

The raw-material alloy, which is used for producing the R—T—B sintered alloy, also usually consists of the $R_2T_{14}B$ phase, the R-rich phase and the B-rich phase. Among these phases, the R-rich phase plays the role of supporting the liquid-phase sintering. This phase plays, therefore, an important role of enhancing the characteristics of the sintered magnet and is, hence, indispensable. Since the R-rich phase is easily oxidizable, it is oxidized in the production steps of the sintered magnet. The R content of the sintered alloy is considerably more than that of the $R_2T_{14}B$, which is 11.8 at %. This enables an effective R-rich phase, even after the oxidation, to remain at a certain greater level during the sintering.

On the other hand, the volume fraction of the $R_2T_{14}B$ phase, i.e., the ferromagnetic phase, must be increased as the performance of the sintered magnet is more enhanced. This, in turn, leads to decrease in the volume fraction of R-rich phase. Therefore, when the raw-material alloy is cast by the block mold casting method, the R-rich phase detrimentally disperses in the ingot and becomes locally insufficient. When the raw material powder crushed from such ingot is used for the sintered magnet, it is difficult to obtain satisfactory magnetic properties.

Meanwhile, the dendritic α Fe phase is more likely to form in the alloy which has a higher composition of the $R_2T_{14}B$ phase volume fraction. This α Fe phase dedrimentally impairs the crushability of the raw-material alloy, so that the composition of the crushed powder varies. The magnetic properties of the sintered magnet are lowered and increasingly disperse as well. A considerable amount of the α Fe phase can be diminished by means of heat treating the raw material in inert gas, such as Ar, or under vacuum at 1000° C. or higher for an extended time. However, upon application of this heat treatment, since the dispersion of the R-rich phase is impaired, the magnetic properties cannot be improved.

Such problems are involved in the production of a high-performance sintered magnet. A strip casting method is proposed to solve these problems (for example, Japanese Unexamined Patent Publication (kokai) No. 5-22488 and Japanese Unexamined Patent Publication (kokai) 5-295490). This method resides in the production of an alloy by means of feeding melt on the surface of a rotary roll, while the circumferential speed of the roll and melt-feeding amount are controlled to produce a thin strip alloy having from approximately 0.1 to 0.5 mm of average thickness. Therefore, this method enables a higher cooling speed in solidification than in the conventional block-mold casting method. It is, therefore, possible to finely disperse the R-rich phase and to suppress formation of the dendritic α Fe phase in the alloy produced. By means of this method, no dendritic α Fe phase can be formed in the alloy, for example in the case of Nd-Fe-B based alloy, as long-as Nd content is up to approximately 28.5% by weight.

Meanwhile, a two-alloy mixing method has been proposed (for example Japanese Unexamined Patent Publication (kokai) No. 4-338607), such that an R—T—B alloy with a low R content (hereinafter referred to as "the main-phase alloy") and an R—T or R—T—B alloy with a high R content (hereinafter referred to as "the boundary-phase alloy") are prepared separately, and are mixed to produce a sintered magnet. By means of adding Co to the boundary-phase alloy, chemically stable $R_3$(Fe.Co) is formed and suppresses oxidation of the boundary-phase alloy during the production of a sintered magnet (Japanese Unexamined Patent Publication (kokai) No. 7-283016).

When the fine powder of the R—T—B alloy is slightly surface-oxidized, it is not suddenly oxidized even on exposure to ambient air, and can, therefore, be shaped under a magnetic field in ambient air. Fine pulverization is usually carried out in the production of a sintered magnet. A jet mill is used, for example, for the fine pulverization in the inert-gas atmosphere, in which trace amount of oxygen is incorporated. The thus produced fine powder of from 4000 to 10000 ppm of oxygen concentration can be shaped under the magnetic field in ambient air.

However, the permissible oxygen concentration to avoid lowering the magnet properties is lower in a high-performance sintered magnet with lower R content and hence, a less R-rich phase. It is, therefore, impossible to oxidize the surface of fine powder as described above, since the less R-rich phase must be effectively utilized. The shaping under the magnetic field must be carried out, while taking such measures as mounting the entire metal die in a glove box, establishing the protective gas atmosphere of $N_2$ and Ar in the glove box, and carrying out the magnetic-field shaping in the glove box. In the other steps, the causes of the oxidation must be eliminated as much as possible. The cost is accordingly increased.

Meanwhile, it is necessary to suppress the grain size to approximately 10 to 30 μm so as not to decrease the coercive force and squareness ratio of the sintered magnet. However, when the oxygen concentration of the sintered magnet is suppressed to an extremely low level, abnormal growth of crystal grains is likely to occur during the sintering, occasionally up to approximately 1 mm.

SUMMARY OF INVENTION

The present inventors considered a raw-material alloy, which is difficult to be oxidized and to undergo the abnormal growth of crystal grains in the production process of the sintered magnet, and which is used for producing a high-performance R—Fe—B sintered magnet. They also considered a method for producing said sintered magnet. More particularly, the present inventors considered a raw-material alloy, which is used for producing a high coercive-force rare earth sintered magnet which is used, in turn, mainly for a motor or the like. They also considered a producing method of such sintered magnet. As a result, the discovery was made that, when the sintered magnet is produced by a two-alloy mixing method, specifically when the main-phase alloy with an R component less than that of $R_2T_{14}B$ and the boundary-phase alloy are mixed, only slight oxidation occurs during the production process of the sintered magnet, and no abnormal growth of crystal grains occurs during the sintering. Based on this discovery, the present invention was attained.

Namely, the present invention provides a raw-material alloy used for producing an R—T—B sintered magnet consisting of $R_2T_{14}B$, in which R is at least one rare-earth element including Y, and T is Fe, a part of which may be replaced with one of or both Co and Ni, and B is B (boron), a part of which may be replaced with one of or both C and N, characterized in that said R is from 10 to 11.8 at % in total of the rare earth elements consisting of from 1 to 6 at % of Dy, the balance being at least one of Nd and Pr, the B content is from 5.88 to 8.00 at %, the dendritic α Fe phase may be dispersed in the first region of the matrix, the lamellar α Fe phase is dispersed in the second region other than the first region, the total of the α Fe phase and the first region is from 0 to 10% by volume (namely, no α Fe phase may be formed, and hence this total may be 0% by volume), and the total of the second region and the lamellar α Fe phase is 5% by volume or more.

Namely, the present invention relates to a method for producing the sintered magnet by means of mixing the R—T—B main-phase alloy, which has so little R content that essentially no R-rich phase is present and cannot be liquid-phase sintered alone, and the R—T or R—T—B boundary-alloy, which has sufficient R content to supply the R-rich phase into the present main-phase alloy. The present invention is characterized by the following (1) through (3).

(1) Main-phase alloy

Regarding the structure, the dendritic α Fe phase is dispersed and formed (described more in detail hereinbelow) in a region of the matrix consisting of $R_2T_{14}$ B, in which R is at least one rare-earth element including Y, and T is Fe, a part of which may be. replaced with one of or both Co and Ni, and B is B (boron), a part of which may be replaced with one of or both C and N. Such region is 10% by volume or less.

Regarding the composition, R essentially consists of Nd, Pr and Dy; their total content is from 10 to 11.8 at %, and Dy is from 1 to 6 at %. The B content is from 5.88 to 8.00 at %. The balance consists of T.

(2) Boundary-phase Alloy

This is R—T alloy or R—T—B alloy which contains 15 at % or more of R. Preferably, the Co content is 1 at % or more.

(3) Production method of sintered magnet

The main-phase alloy in an amount of 60% by weight or more and the boundary-phase alloy in an amount of 40% by weight or less are mixed to produce the sintered magnet.

The present invention is described in detail hereinafter.

The main-phase alloy according to the present invention is characterized in that it is produced by the strip casting method and is free of the easily oxidizable, lamellar R-rich phase which is present in the usually used raw-material alloy for producing the sintered magnet. Instead, the lamellar α Fe phase is formed. The oxidation during the production of the sintered magnet can, therefore, be suppressed.

The main constituent phases of the main-phase alloy of the present invention are the lamellar α Fe phase, and in addition, the $R_2T_{14}$ B phase and the B-rich phase. These are the other matrix phases. In addition, the dendritic α Fe phase and the dendritic $R_2T_{17}$ phase may occasionally be formed. In the case of formation of these phases, the composition is unbalanced so that the R-rich phase is numerously formed in the neighborhood of these phases. The present invention is described more in detail with reference to the drawings.

BEST MODE FOR CARRYING OUT INVENTION

Figure 1:
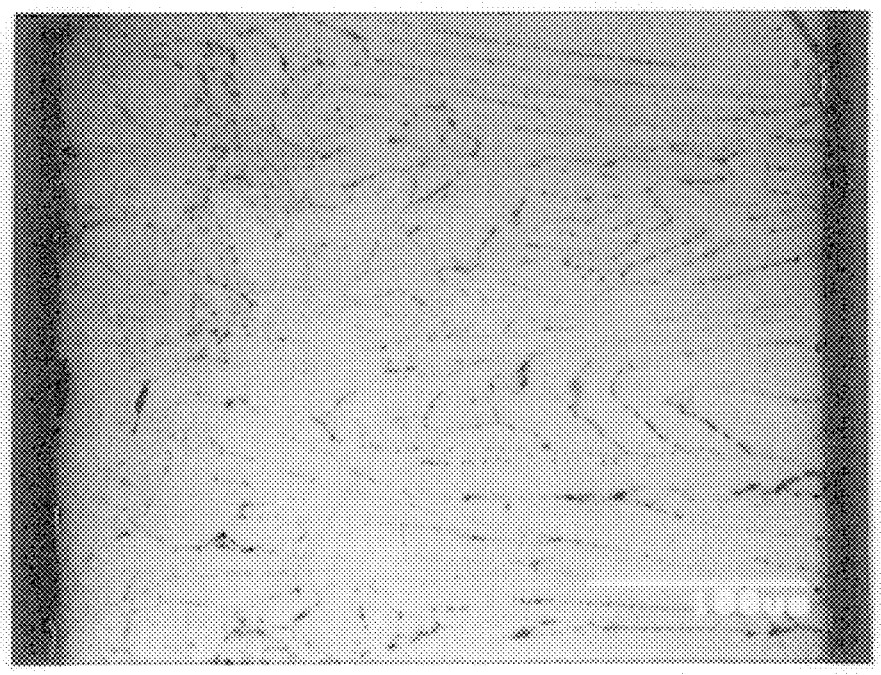
FIG. 1 is an SEM diffraction electron-microscope photograph of the main-phase alloy produced in the inventive Example 1.
Figure 2:
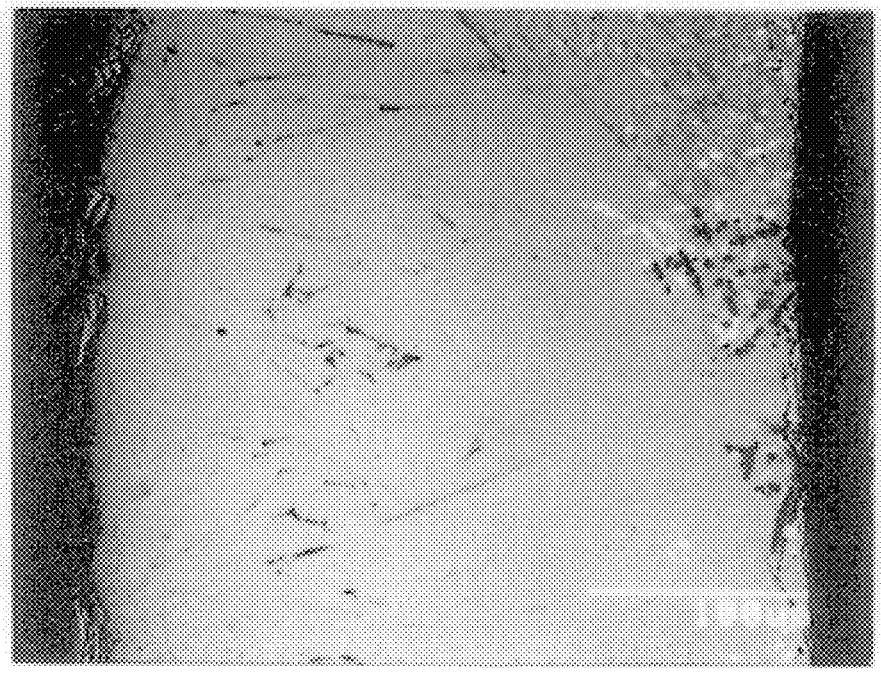
FIG. 2 is an SEM diffraction electron-microscope photograph of the main-phase alloy produced in the inventive Example 2.

FIGS. 1 and 2 are the SEM diffraction electron-microscope photographs showing the representative inventive structure. The phase appearing gray in FIGS. 1 and 2 is the $R_2T_{14}$ B matrix phase. The phase appearing as thin black lines is the lamellar α Fe phase. In addition, a number of thin black spots in FIG. 2 is the $R_2T_{17}$ phase in the form of dendrite, and a number of dense black spots is the dendritic α Fe phase. A number of white spots in the neighborhood of the dendritic $R_2$T17 phase and the dendritic α Fe phase are the R-rich phase formed due to unbalancing of the composition.

Figure 3:
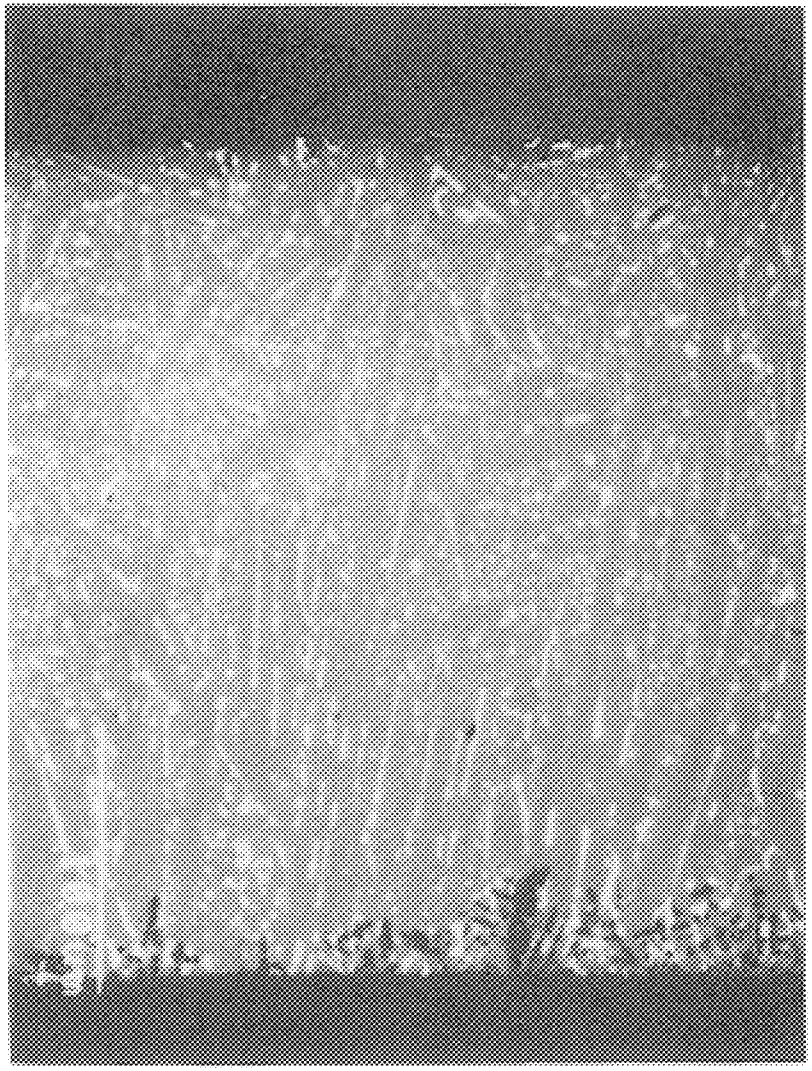
Fig.3 PRIOR ART
FIG. 3 is an SEM diffraction electron-microscope photograph of the known main-phase alloy.

The main constituent phases of the raw-material alloy usually used for producing the R—T—B sintered magnet having the known structure are the $R_2T_{14}$ B matrix phase, the lamellar R-rich phase, and the B-rich phase. In addition, the dendritic α Fe phase may occasionally be formed. In the case of formation of this phase, the composition is unbalanced so that the R-rich phase is formed in the neighborhood of this phase. This known structure is shown in FIG. 3, which is an SEM diffraction electron-microscope photograph. The phase appearing gray in FIG. 3 is the $R_2T_{14}$ B matrix phase, while the phase appearing as white lines is the lamellar R-rich phase. In addition, a number of the dense dark spots is the dendritic α Fe phase. A number of white spots in the neighborhood of the dendritic α Fe phase is the R-rich phase formed due to unbalancing of the structure.

Incidentally, the melting point of the R-rich phase is approximately 660° C. When the cooling speed after the casting solidification to 660° C. is slow, or when the heat treatment is carried out at 660° C. or higher, the R-rich lamellae are cut into pieces and tend to be round. The R-rich phase, the morphology of which is modified as such, is also deemed to be lamellar.

From the comparison of FIGS. 1 and 2 with FIG. 3, it turns out that the structure of the main-phase alloy according to the present invention is clearly different from that of the raw-material alloy having the known structure and which is usually used for producing the R—T—B sintered magnet.

In the main-phase alloy of the present invention, the R component is less than that of $R_2T_{14}$ B phase, and hence essentially no lamellar R-rich phase, which is seen in the known structure, is present due to the insufficient R component, while the Fe component which is excessive relative to the R component is present as the lamellar phase. Its formation amount, that is, the total of the lamellar α Fe phase dispersed and formed in the second region of the $R_2T_{14}B$ matrix phase and the first matrix region is 5% by volume or more.

Meanwhile, the dendritic α Fe phase is detrimental to the productivity and magnetic properties of the sintered magnet. Regarding the dendritic α Fe phase, its formation region (that is, the total of the dendritic α Fe phase dispersed and formed in the first region of the $R_2T_{14}B$ matrix phase and the first matrix region) is 10% by volume or less, preferably 5% by volume, more preferably 0% by volume. When the formation region of the dendritic α Fe phase exceeds 10% by volume, the crushability of the raw-material powder is seriously impaired, causing composition variation in the crushing, and also incurring a decrease of the magnetic properties and an increase in their variance.

Regarding the method for measuring the formation region of the lamellar α Fe phase and the formation region of the dendritic α Fe phase, since the volume % and the area % can be considered to be equivalent, for example, the cross-sectional structure of alloy is photographed as the SEM diffraction electron image, and an image processing device is used to obtain such regions. Since the appearance of the structure may be different depending upon the observation locations, ten or more optional locations of the cross-section are photographed as the SEM diffraction electron images. The total observed, cross-sectional areas and the total formation areas of lamellar α Fe phase or dendritic α Fe phase are calculated, and the ratio of both phases is calculated.

The $R_2T_{17}$ phase, among the constituent phases of the main-phase alloy of the present invention, incurs no problems in the production process of the sintered magnet such as decrease in the crushing efficiency. In addition, this phase is magnetically soft and hence lowers the coercive force and squareness ratio, when present in the sintered magnet. This phase, however, disappears during the sintering, when the mixed grains of the boundary-phase alloy and the main-phase alloy having appropriate composition are sintered.

Hereafter, the method for producing the main-phase alloy of the present invention is described. The dendritic α Fe phase, which is detrimental, is formed in most portions of the alloy produced by the ordinary block-mold casting. In order to suppress the formation of such dendritic α Fe phase, the solidification must be carried out at a higher cooling speed than in the conventional block-mold casting method. For example, the strip casting method is suitable. Since a thin sheet having from 0.1 to 0.5 mm of average thickness can be cast by this method, the solidification proceeds under higher cooling speed than in the conventional block-mold casting method. There are single-roll method and a double-roll method in the strip-casting method. Either method can be selected, but the single-roll method is preferred because the apparatus is simple, and further, the operating conditions are easily controlled. In order to further enhance the solidification speed on the roll, He atmosphere having high heat conductivity may be used for the roll environment. Incidentally, the method for producing the main-phase alloy of the present invention is not limited to the strip-casting method any method capable of providing the inventive structure can be appropriately selected.

The composition of the main-phase alloy to provide the inventive structure is that: R essentially consists of Nd, Pr and Dy; their total content is from 10 to 11.8 at %, including from 1 to 6 at % of Dy; the B content is from 5.88 to 8.00 at %; and, the balance consists of T.

When R is more than 11.8 at %, the lamellar R-rich phase, which is easily oxidizable, is formed. On the other hand, when R is less than 10 at %, a large amount of the dendritic α Fe phase is formed no matter how rapid the cooling speed is after the casting, such as the strip-casting method. It is, thus, impossible to suppress formation region of the dendritic α Fe phase to 10% by volume or less. The R content is, therefore, limited to from 10 to 11.8 at %.

Since the formation of the dendritic α Fe phase is suppressed by Dy, its inclusion is important in the present invention. When the Dy content is 1 at % or more, the formation region of the dendritic α Fe phase can be kept to 10% by volume or less. Although the formation of the dendritic α Fe phase becomes more difficult with an increase in the Dy content, Dy is expensive and lowers the magnetization of the sintered magnet. The Dy content is, therefore, limited to 6 at % or less from a practical point of view. The Dy content is limited to from 1 to 6% from the reasons described above. Incidentally, since Dy has a large anisotropy field, the sintered magnet containing Dy has, therefore, high coercive force. The sintered magnet according to the present invention is, therefore, suited for use in a motor which is elevated to high temperature and is exposed to a reverse magnetic field. High coercive force is necessary for such magnet.

Regarding B, when it is less than 5.88 at %, a large amount of the dendritic α Fe phase is formed so that its formation region cannot be kept to 10% by volume or less. In addition, when the R—T alloy free of B is used as the boundary-phase alloy, no matter how the blending proportion of the boundary-phase alloy and the main-phase alloy is adjusted, B is insufficient in the blending composition. As a result, the $R_2Fe_{17}$ phase, which is magnetically soft, is present after sintering, so that the coercive force and squareness ratio are lowered. On the other hand, the dendritic α Fe phase becomes more difficult to form with an increase in the B content. However, when the B content exceeds 8.00 at %, and when almost 0% of the non-magnetic B-rich phase is to be attained after sintering, by means of adjusting the blending proportion, the R content of the sintered magnet is correspondingly somewhat high. In this case, the residual flux density becomes low. Similarly, high magnetic flux density after sintering can be attained by keeping the R content of the blending composition low. In this case, a large amount of the B-rich phase remains after sintering, and the residual flux density becomes low, as well. B of the main-phase alloy is, therefore, limited to from 5.88 to 8.00 at %.

Regarding the composition of boundary-phase alloy according to the present invention, 15 at % or more of R must be contained. When R of the boundary-phase alloy is less than 15 at %, the α-Fe phase is easily formed. Insufficient B in the sintered composition can be avoided, when the boundary-phase alloy having less than 15 at % of R is mixed with the main-phase alloy having high content of B. This, in turn, leads to decrease of the R component after mixing, and hence, considerable reduction of the permissible oxygen for ensuring good magnetic properties. As a result, the production of a sintered magnet having good magnetic properties becomes practically impossible. 15 at % or more of R must, therefore, be contained in the boundary-phase alloy.

One of or both R—T alloy and R—T—B alloy can be mixed for use as the boundary-phase alloy.

The boundary-phase alloy of the present invention can be produced by the ordinary block-mold casting method, centrifugal casting method (for example, Japanese Unexamined Patent Publication (kokai) No.8-296005), and the strip casting method. Any one production method may be selected appropriately in the light of effectiveness in the crushing, including the hydrogen decrepitation, and the economy involved in the production.

The main-phase alloy and the boundary-phase alloy produced as described above are mixed and then sintered to provide the magnet. The blending is such that the main-phase alloy is 60% by weight or more and the boundary-phase alloy is 40% by weight or less. When the main-phase alloy is less than 60% by weight and the boundary-phase alloy is more than 40% by weight in the blending composition, the R content in the sintered alloy is excessive so that the residual flux density is lowered. It is, therefore, necessary to blend 60% by weight or more of the main-phase alloy and 40% by weight or less of the boundary-phase alloy.

In addition, since Co has the effect of improving corrosion resistance, and further, the boundary-phase alloy contains a large amount of R and is easily oxidizable, 1 at % or more of Co is preferably contained in such boundary-phase alloy. Chemically stable $R_3$(Fe.Co) is formed by means of including 1 at % or more of Co, and it can suppress the oxidation during the production of the sintered magnet. In addition, since the sintered magnet is produced by mixing the boundary-phase alloy and the main-phase alloy, Co is also contained in the sintered magnet and can improve the temperature characteristics of coercive force and the corrosion resistance. However, when the Co content is less than 1 at %, these effects are minimal.

The main-phase alloy and the boundary-phase alloy are subjected to hydrogen decrepitation, middle crushing and fine pulverizing. The middle crushing is carried out, for example, by a Brown mill or the like under $N_2$ gas or inert gas such as Ar gas until approximately 0.5 mm or less is attained. The fine pulverizing is carried out by means of a jet mill under $N_2$ gas or inert gas such as Ar gas, a ball mill in the organic solvent or the Attoritor until 2–5 $\mu$m is attained, measured by a Fisher-type sub-sieve sizer (FSSS). The hydrogen decrepitation, can be applied to the strip shape as is. Desirably, a strip is roughly crushed to 10 mm or less, so as to expose the metal surface before the hydrogen decrepitation.

Among these crushing steps, the hydrogen decrepitation may be omitted. The middle crushing may directly follow the rough crushing. Alternatively, if the conditions for the hydrogen decrepitation are appropriately selected, the middle crushing may be omitted; the fine pulverizing may directly follow the hydrogen decrepitation.

Regarding the mixing of the main-phase alloy and the boundary-phase alloy, it may be carried out in any crushing step of the rough crushing, hydrogen decrepitation, middle crushing and fine pulverizing. Namely, what is important in the present invention is that these alloys are uniformly mixed up to the shaping step under a magnetic field, while there is no limitation in the present invention as to the selection of the crushing methods and the mixing method. Desirably, uniform mixing is carried out in a V-type blender or the like under inert gas. In order to enhance the orientation degree by the shaping under a magnetic field, from 0.01 to 1% by weight of a lubricant, such as zinc stearate, is desirably added to the mixed powder.

The hydrogen absorption is carried out in the hydrogen decrepitation step of the main-phase alloy and is preferably carried out at a temperature of 100° C. or higher under hydrogen atmosphere. The hydrogen pressure in the hydrogen atmosphere in the absorption is preferably from 200 Torr to 10 kgf/cm$^2$ from the viewpoint of economy and safety. The dehydrogenation step is, preferably, carried out by thoroughly cooling the alloy which has undergone heat generation in the hydrogen absorption step, and then subjecting the alloy to the primary dehydrogenation by exposing the alloy to vacuum at normal temperature and, further, to the secondary dehydrogenation by holding at 400° C. to 750° C. for 30 minutes or more under vacuum. The oxidation resistance in the subsequent steps is enhanced by this dehydrogenation step. The primary dehydrogenation can be omitted from the viewpoint of operation efficiency.

The uniformly mixed fine powder is shaped by a shaping machine under a magnetic field in ambient atmosphere or inert gas, and is then sintered at 1000–1100° C. in vacuum or inert-gas atmosphere such as Ar gas. In the case that the hydrogen decrepitation is carried out, the hydrogen in the shaped compact must be completely removed before the sintering, so as to attain satisfactory sintering. For this purpose, the holding in vacuum at 700–900° C. must be carried out for 1 hour or longer. Aging after the sintering increases the coercive force. A preferable aging condition is to hold at 500–700° C. in vacuum or inert gas atmosphere such as Ar gas for 1 hour or longer, followed by rapid cooling.

No abnormal growth of crystal grains occurs in the sintered magnet obtained by the present invention, even if the oxygen content is suppressed to a low level. The reason for this is not clear, but seems to be attributable to suppression of the growth of crystal grains by a large amount of the B-rich phase present up to the vicinity of 1040° C. It is also a feature of the present invention that a large amount of the B-rich phase is present in the main-phase alloy.

The composition in the present invention is supplementarily described.

The T component of the main-phase alloy of the present invention is Fe, which is essential and which can be partly replaced with one of or both Co and Ni for improving the corrosion resistance and temperature-characteristics of the sintered alloy. However, the total amount of replacement must not exceed 50% by weight or more of the T component of the post-sintered composition. In excess of 50% by weight, not only is high coercive force not obtained but also the squareness ratio is lowered.

In addition, the B component of the main-phase alloy according to the present invention can be partly replaced with one of or both C and N. However, the total amount of replacement must not exceed 30% by weight of the B+C+N component of the post-sintered composition. In excess of 30% by weight, not only is high coercive force not obtained but also the squareness ratio is lowered.

In addition, in order to improve the aging-temperature dependence of the coercive force, Cu can be added to the main-phase alloy and the boundary-phase alloy. In order to enhance the coercive force, one of or a plurality combination of Al, Ti, V, Cr, Mn, Nb, Ta, Mo, W, Ca, Sn, Zr and Hf may be added to the main-phase alloy and the boundary-phase alloy. However, in order not to lower the residual flux density of the sintered magnet, the total addition amount of these elements, including Cu, must not exceed 5% by weight of the post mixed and sintered composition.

In the main-phase alloy and the boundary-phase alloy of the present invention, presence of such impurities unavoidably contained in the industrial production as Y, La, Ce, Sm, C, O, N, Si and Ca is permitted.

As described hereinabove, an alloy supplied according to the present invention is optimum for producing a high-performance sintered magnet, the permissible oxygen concentration of which is, for example, 3000 ppm or less, and in which the abnormal growth of crystal grains is difficult to occur during the sintering.

EXAMPLES AND COMPARATIVE EXAMPLES

The present invention is furthermore described in detail with reference to the examples.

Example 1

The main-phase alloy having a composition described in Table 1 was melted and then cast by a strip casting method (1450° C. of casting temperature). A roll of made of copper, used in the strip casting had a 40-cm diameter. The circumferential speed of the roll made of copper was 0.98 m/second. The obtained alloy was in the form of flakes and its average thickness was 0.35 mm.

The diffraction electron microscope photograph of the alloy's cross-section by SEM is shown in FIG. 1. A quantitative analysis of the respective phases was carried out by EDX (energy dispersion type X-ray analyzing apparatus). XRD (X-ray diffractometry of powder) was also carried out. From these results, the matrix phase, which appears gray in this photograph, was was the $R_2Fe_{14}B$ phase, and the lamellar phase, which appears in the form of black lines, is the α Fe phase. Neither the lamellar R-rich phase nor the dendritic α Fe phase was confirmed. The B-rich phase was confirmed by the XRD. The B-rich phase was not confirmed in the diffraction electron image, probably because the diffraction electron image of the B-rich phase is very similar in color to that of the $R_2Fe_{14}B$ phase and hence the two phases are indistinguishable from one another.

The diffraction electron image of an alloy flake's cross-section was analyzed by the image processing apparatus at ten optional locations, to obtain the formation region of the lamellar α Fe phase, which turned out to be 95% by volume. In the remaining 5% by volume, only the $R_2Fe_{14}B$ phase was observed.

Example 2

The main-phase alloy having a composition shown in Table 1 was cast by the same strip casting method as in Example 1. The alloy in the form of flakes and having 0.30 mm of average thickness was obtained. The diffraction electron microscope of the alloy's cross-section by SEM was as shown in FIG. 2. A quantitative analysis of the respective phases was carried out by EDX. XRD was also carried out. From these results, the matrix phase, which appears gray in this photograph, is the $R_2Fe_{14}B$ phase; the lamellar phase, which appears in the form of black lines, is the α Fe phase, the phase in the form of a number of black spots is the dendritic $R_2Fe_{17}$ phase, and a phase, which appears dense black, is the dendritic α Fe phase. In addition, the R-rich phase appears as white spots in the circumferential portions of the dendritic $R_2Fe_{17}$ phase and the dendritic α Fe phase. The formation regions of the lamellar α Fe phase and the dendritic α Fe phase were quantitatively obtained by the same method as in Example 1. The results are shown in Table 1.

Example 3

The main-phase alloy having a composition shown in Table 1 was cast by the same strip casting method as in Example 1. The alloy in the form of flakes and having 0.32 mm of average thickness was obtained.

From the SEM diffraction electron image, EDX and XRD of the alloy's cross-section, the following main phases were identified and confirmed: the $R_2Fe_{14}B$ matrix phase; the lamellar α Fe phase; the dendritic $R_2Fe_{17}$ phase; and the dendritic α Fe phase. In addition, the R-rich phase appears as a number of spots in the circumferential portions of the dendritic $R_2Fe_{17}$ phase and the dendritic α Fe phase. The formation of the B-rich phase was confirmed only by XRD but not by the other methods. The formation regions of the lamellar α Fe phase and the dendritic α Fe phase were quantitatively obtained by the same method as in Example 1. The results are shown in Table 1.

Example 4

The main-phase alloy having a composition shown in Table 1 was cast by the same strip casting method as in Example 1. In the composition of this alloy, the Fe component of the alloy in Example 1 was partially replaced with Co. The alloy in the form of flakes and having 0.33 mm of average thickness was obtained.

From the SEM diffraction electron image, EDX and XRD of the alloy cross-section, the following main phases were confirmed to be formed: the $R_2(Fe.Co)_{14}B$ phase and the lamellar α Fe phase. The formation of the B-rich phase was confirmed only by XRD but not by the other methods.

The formation regions of the lamellar α Fe phase and the dendritic α Fe phase were quantitatively obtained by the same method as in Example 1. The results are shown in Table 1.

Comparative Example 1

The main-phase alloy had a larger R amount than that for forming the $R_2$ $Fe_{14}B$ phase as shown in Table 1. This main-phase alloy was cast by the strip casting method under the same conditions as in Example 1 to obtain the alloy in the form of flakes having 0.30 mm of average thickness. The formation regions of this alloy were investigated by the same method as in Examples 1 through 3. It turned out that a large amount of the lamellar R-rich phase and a small amount of the dendritic α Fe phase and B-rich phase were formed. The R-rich phase in the form of a number of spots was formed in the circumference of the dendritic α Fe phase. No lamellar α Fe phase was confirmed. The formation of the B-rich phase was confirmed only by XRD but not by the other methods.

The formation regions of the lamellar α Fe phase and the dendritic α Fe phase were quantitatively obtained by the same method as in Example 1. The results are shown in Table 1.

Comparative Example 2

The main-phase alloy free of Dy as shown in Table 1 was cast by the strip casting method under the same conditions as in Example 1. Average thickness of the alloy obtained in the form of flakes was 0.29 mm.

The formation phases were investigated by the same method as in Examples 1 through 3. They were the $R_2Fe_{14}B$ matrix phase; the lamellar α Fe phase; the dendritic α Fe phase; and the B-rich phase. In addition, the R-rich phase in the form of a number of spots was formed in the circumferential portions of the dendritic α Fe phase. The formation of the B-rich phase was confirmed only by XRD but not by the other methods.

The formation regions of the lamellar α Fe phase and the dendritic α Fe phase were quantitatively obtained by the same method as in Example 1.

The results are shown in Table 1.

Comparative Example 3

The main-phase alloy free of Dy as shown in Table 1 was cast by the strip casting method under the same conditions as in Example 1 to obtain the alloy in the form of flakes having 0.33 mm of average thickness.

The formation phases were investigated by the same method as in Examples 1 through 3. They were the $R_2Fe_{14}B$ matrix phase; the lamellar α Fe phase; and the dendritic α Fe phase. In addition, the R-rich phase in the form of a number of spots was formed in the circumferential portions of the dendritic α Fe phase.

The formation regions of the lamellar α Fe phase and the dendritic α Fe phase were quantitatively obtained by the same method as in Example 1.

The results are shown in Table 1.

Comparative Example 4

The main-phase alloy containing a large amount of Dy as shown in Table 1 was cast by the strip casting method under the same conditions as in Example 1 to obtain the alloy in the form of flakes having 0.31 mm of average thickness.

The formation phases were investigated by the same method as in Examples 1 through 3. They were the $R_2Fe_{14}B$ matrix phase; the lamellar α Fe phase; the dendritic $R_2Fe_{17}$ phase; and the dendritic α Fe phase. In addition, the R-rich phase in the form of a number of spots was formed in the circumferential portions of the dendritic $R_2Fe_{17}$ phase and the dendritic α Fe phase. The formation of the B-rich phase was confirmed by XRD but not by the other methods.

The formation regions of the lamellar α Fe phase and the dendritic α Fe phase were quantitatively obtained by the same method as in Example 1. The results are shown in Table 1.

Comparative Example 5

The main-phase alloy containing a large amount of B as shown in Table 1 was cast by the strip casting method under the same conditions as in Example 1 to obtain the alloy in the form of flakes having 0.32 mm of average thickness. The formation phases were investigated by the same method as in Examples 1 through 3. They were the $R_2Fe_{14}B$ matrix phase; the lamellar α Fe phase; the dendritic $R_2Fe_{17}$ phase; and the dendritic α Fe phase. In addition, the R-rich phase in the form of a number of spots was formed in the circumferential portions of the dendritic $R_2Fe_{17}$ phase and the dendritic α Fe phase. It was confirmed by XRD that a larger amount of the B-rich phase formed than in Examples 1 through 3.

The formation regions of the lamellar α Fe phase and the dendritic α Fe phase were quantitatively obtained by the same method as in Example 1.

The results are shown in Table 1.

TABLE 1

Composition, Thickness and Structure of Main-Phase Alloy

| | Nd + Pr + Dy at % | Nd at % | Pr at % | Dy at % | B at % | Co at % | Fe at % | Thickness of Alloy mm | Formation Region of Lamellar α Fe Volume % | Formation Region of Dendritic α Fe Volume % |
|---|---|---|---|---|---|---|---|---|---|---|
| Example 1 | 11.67 | 8.63 | 0.01 | 3.03 | 7.05 | 0 | 81.28 | 0.35 | 95 | 0 |
| Example 2 | 11.76 | 9.04 | 0.01 | 2.71 | 5.93 | 0 | 82.31 | 0.30 | 72 | 2 |
| Example 3 | 10.42 | 8.24 | 0.01 | 2.17 | 7.90 | 0 | 81.68 | 0.32 | 14 | 9 |
| Example 4 | 11.67 | 8.64 | 0.01 | 3.02 | 7.05 | 0.54 | 80.74 | 0.33 | 94 | 0 |
| Comparative Example 1 | 12.44 | 12.43 | 0.01 | 0 | 7.07 | 0 | 80.49 | 0.30 | 0 | 1 |
| Comparative Example 2 | 11.69 | 11.67 | 0.02 | 0 | 7.00 | 0 | 81.31 | 0.29 | 71 | 22 |
| Comparative Example 3 | 9.92 | 9.90 | 0.01 | 0 | 5.03 | 0 | 85.05 | 0.33 | 8 | 88 |
| Comparative Example 4 | 11.77 | 5.32 | 0.01 | 6.44 | 7.13 | 0 | 81.10 | 0.31 | 3 | 0 |
| Comparative Example 5 | 11.58 | 8.59 | 0.01 | 2.98 | 9.00 | 0 | 79.42 | 0.32 | 98 | 0 |

Formed Phase (○: Symbol Confirmed Phase)

| | $R_2T_{14}B$ Phase | Lamellar α Fe | Dendritic α Fe | Dendritic $R_2T_{14}$ Phase | Spot like R rich Phase | B-rich Phase | Lamellar B-rich Phase |
|---|---|---|---|---|---|---|---|
| Example 1 | ○ | ○ | | | | ○ | |
| Example 2 | ○ | ○ | ○ | ○ | ○ | | |
| Example 3 | ○ | ○ | ○ | ○ | ○ | ○ | |
| Example 4 | ○ | ○ | | | | ○ | |
| Comparative Example 1 | ○ | | ○ | | ○ | ○ | ○ |
| Comparative Example 2 | ○ | ○ | ○ | | ○ | ○ | |
| Comparative | ○ | ○ | ○ | | ○ | | |

TABLE 1-continued

| Composition, Thickness and Structure of Main-Phase Alloy | | | | | | |
|---|---|---|---|---|---|---|
| Example 3 | | | | | | |
| Comparative Example 4 | ○ | ○ | ○ | ○ | ○ | ○ |
| Comparative Example 5 | ○ | ○ | ○ | ○ | ○ | ○ |

Example 5

The boundary-phase alloy "R Alloy 1" described in Table 2 was cast using a mold made of copper to provide 5 mm of thickness. Crushing by a jaw crusher was carried out to attain 5 mm or less. The SEM diffraction electron image and EDX observed the cross-section of this alloy, but no α Fe phase was detected.

Subsequently, the main-phase alloy, which had been crushed to 5 mm or less, and R Alloy 1 were blended in a weight proportion of 83:17. Under this weight proportion, almost no B-rich phase should be present in the composition after sintering and manufacturing of the magnet. This blended matter was uniformly mixed in a V-type blender under $N_2$ gas. The hydrogen decrepitation was then carried out. The dehydrogenation conditions were under vacuum, 500° C. and holding for 1 hour.

The resultant mixed powder was crushed by a Brown mill in $N_2$ gas down to 0.5 mm or less. After uniformly blending 0.05 wt % of zinc stearate to this mixed powder, it was pulverized by a jet mill in $N_2$ gas. The resultant mixed fine powder had 3.4 μm (FSSS) of average particle size and was shaped under the magnetic field.

The resultant green compact was loaded in a vacuum furnace and was completely dehydrogenated by holding at 800° C. for 1 hour. Subsequently, the sintering was carried out by holding at 1060° C. for 3 hours thereby sintering. Aging was then carried out at by holding 560° C. for 1 hour in vacuum, followed by rapid cooling. The magnetic properties of the resultant sintered compact are described in Table 4.

In addition, the cross-section of a sintered compact was observed by a magnetic Kerr effect microscope. The grain size was from 10 to 15 μm, and no abnormally grown crystal grains were confirmed.

Example 6

The boundary-phase alloy "R Alloy 2" described in Table 2 was produced by the same method as in Example 5. Crushing by a jaw crusher was carried out to attain 5 mm or less. The SEM diffraction electron image and EDX observed the cross-section of this alloy, but no α Fe phase was confirmed.

The mixed powder of the main-phase alloy of Example 1 and R Alloy 2 was prepared by the same method as in Example 5. The total Nd, Pr and Dy composition after sintering and production of magnet was virtually the same as Example 5. Subsequently, the main-phase alloy and R Alloy 1 were blended in a weight proportion of 83:17. Under this weight proportion, almost no B-rich phase should be present in the composition after sintering and manufacturing of magnet. The resultant mixed fine powder had 3.3 μm (FSSS) of the average particle size and was shaped under the magnetic field, sintered and aged by the same methods as in Example 5. However, the sintering temperature was 1060° C. and 1100° C.

The magnetic properties of the resultant sintered compact are described in Table 4. In addition, the cross-section of a sintered compact was observed by a magnetic Kerr effect microscope. The grain size of the sintered magnet at 1060° C. was from 10 to 15 μm, while the grain size of the sintered magnet at 1100° C. was from 15 to 20 μm. No abnormally grown crystal grains were detected in any one of the sintered magnets.

Example 7

Mixed fine powder was prepared by using the main-phase alloy of Example 4 and R Alloy 2. The total Nd, Pr and Dy composition after sintering and production of magnet was virtually the same as Example 6. The blending weight proportion of 83:17 so that almost no B-rich phase should be present in the composition after sintering and manufacture of magnet. The resultant mixed fine powder had 3.4 μm (FSSS) of average particle size and was shaped under the magnetic field, sintered and aged by the same methods as in Example 5. However, the sintering temperature was 1060° C. and 1100° C., each holding for 3 hours. The magnetic properties of the resultant sintered compact are described in Table 4.

In addition, the cross-section of a sintered compact was observed by a magnetic Kerr effect microscope. The grain size of the sintered magnet at 1060° C. was from 10 to 15 μm, while the grain size of the sintered magnet at 1100° C. was from 15 to 20 μm. No abnormally grown crystal grains were detected in any one of the sintered magnets.

Example 8

The boundary-phase alloy "R Alloy 3" described in Table 2 was produced by the same method as in Example 5. Crushing by a jaw crusher was carried out to attain 5 mm or less. The SEM diffraction electron image and EDX observed the cross-section of this alloy, but no α Fe phase was detected.

The main-phase alloy of Example 1, R Alloy 2 and R Alloy 3 were used to prepare mixed fine powder by the same method as in Example 5. These alloys were blended in a weight proportion of 80:15:5, so that almost no B-rich phase should be present in the composition after sintering and manufacture of magnet. The resultant mixed fine powder had 3.4 μm (FSSS) of average particle size and was shaped in the magnetic field, sintered and aged by the same methods as in Example 5. However, the sintering temperature was 1060° C. and 1100° C., each holding for 3 hours.

The cross-section of a sintered compact was observed by a magnetic Kerr effect microscope. The grain size of the sintered magnet at 1060° C. was from 10 to 15 μm, while the grain size of the sintered magnet at 1100° C. was from 15 to 20 μm. No abnormally grown crystal grains were detected in any one of the sintered magnets.

Comparative Example 6

The raw materials were blended to provide a similar composition to the mixed powder of Example 6, as described in Table 3. The strip casting was carried out under the same conditions as in Example 1 (single alloy method) to obtain an alloy in the form of flakes and having 0.35 mm of average thickness.

The cross-section of this alloy was observed by the SEM diffraction electron image. As a result, it turned out that the $R_2Fe_{14}B$ matrix phase and in addition the R-rich phase in the form of a large number of lamellae were formed. No dendritic α Fe phase was detected.

The fine powder of this alloy was produced by the same method as in Example 5. However, the hydrogen absorption step of the hydrogen decripitation was carried out only at normal temperature. The resultant mixed fine powder had 3.4 μm (FSSS) of average particle size. Sintered magnet was produced using this powder by shaping in the magnetic field, sintering and aging by the same methods as in Example 5. However, the sintering temperature was 1060° C. and 1100° C., each holding for 3 hours.

The magnetic properties of the resultant sintered compact are described in Table 4. The magnetic properties of the sintered compact at 1100° C. are lower than those of the sintered compact at 1060° C. The demagnetization curve of the sintered magnet at 1100° C. has necking, and its squareness ratio was poor.

The cross-section of a sintered compact was observed by a magnetic Kerr effect microscope. The grain size of the sintered magnet at 1060° C. was from 10 to 15 μm, and no abnormally grown crystal grains were detected. On the other hand, in the case of the sintered magnet at 1100° C., a number of coarse grains of from approximately 0.1 to 0.5 mm were observed on the fracture surface even by the naked eye.

Comparative Example 7

Mixed fine powder was prepared by using the main-phase alloy of Comparative Example 4 and R Alloy 2 by the same method as in Example 5. The blending weight proportion of 83:17 so that almost no B-rich phase is present in the composition after sintering and manufacture of magnet. The resultant mixed fine powder had 3.3 μm (FSSS) of average particle size.

A sintered magnet was produced using this mixed fine powder by shaping under the magnetic field, sintering and aging by the same methods as in Example 5.

The magnetic properties of the resultant sintered compact are shown in Table 4. The composition after magnet manufacture of Example 8 is very similar to Comparative Example 7 except for the Dy component. When these sintered magnets are compared, since the Dy is excessive in the sintered magnet of Comparative Example 7, its intrinsic coercive force (iHc) is very great, while the residual magnetization (Br) and maximum energy product (BH) max are as low as 1.1 kG and 9.8 MGOe, respectively.

The cross-section of a sintered compact was observed by a magnetic Kerr effect microscope. The grain size was from 10 to 15 μm. No abnormally grown crystal grains were detected.

Comparative Example 8

Mixed fine powder was prepared by using the main-phase alloy of Comparative Example 5 and R Alloy 2 by the same method as in Example 5. The blending weight proportion was 83:17 so that the total composition of Nd, Pr and Dy was almost the same as attained in Example 6 with regard to the composition after sintering and manufacture of magnet. The resultant mixed fine powder had 3.4 μm (FSSS) of average particle size.

A sintered magnet was produced using this mixed fine powder by shaping under magnetic field, sintering and aging by the same methods as in Example 5.

The magnetic properties of the resultant sintered compact are shown in Table 4. The composition after magnet manufacture of Example 6 is very similar to Comparative Example 8 except for the B component. When these sintered magnets are compared, since the B is excessive in the sintered magnet of Comparative Example 8, the residual magnetization (Br) and maximum energy product (BH) max are as low as 0.6 kG and 4.3 MGOe, respectively.

The cross-section of a sintered compact was observed by a microscope. The grain size was from 10 to 15 μm. No abnormally grown crystal grains were detected.

Comparative Example 9

Mixed fine powder was prepared by using the main-phase alloy of Comparative Example 2 and R Alloy 2 by the same method as in Example 5. The blending weight proportion was 83:17 so that almost no B-rich phase should be present in the composition after sintering and manufacture of magnet. The resultant mixed fine powder had 3.4 μm (FSSS) of average particle size.

A sintered magnet was produced using this mixed fine powder by shaping in magnetic field, sintering and aging by the same methods as in Example 5.

The magnetic properties of the resultant sintered compact are shown in Table 4. The squareness of the demagnetization curve was considerably worse. Analysis of the Fe component of this sintered magnet revealed decrease by 0.4 wt % from that of the mixed powder after crushing by the Brown mill. Analysis of the Fe component of the powder remaining in the jet milling apparatus revealed increase by 1.5 wt % over that of the mixed powder after crushing by the Brown mill. It was confirmed from these facts that: since the dendritic α Fe phase is difficult to be finely pulverized by jet milling, if a large amount of this α Fe phase is formed in the main-phase alloy, such phase remains in the jet mill; the powder composition thus deviates from the original composition toward an R-rich one; and the magnetic properties are lowered due to the shift in the powder composition and the α Fe phase contained in the powder.

TABLE 2

| | Composition of Boundary-Phase Alloy | | | | | | | |
|---|---|---|---|---|---|---|---|---|
| | Nd + Pr + Dy at % | Nd at % | Pr at % | Dy at % | B at % | Co at % | Cu at % | Fe at % |
| R Alloy 1 | 28.57 | 25.59 | 0.02 | 2.96 | 0 | 0 | 0 | 71.43 |
| R Alloy 2 | 28.6 | 25.68 | 0.02 | 2.96 | 0 | 4.28 | 0.35 | 66.71 |

TABLE 2-continued

| | Composition of Boundary-Phase Alloy | | | | | | | |
|---|---|---|---|---|---|---|---|---|
| | Nd + Pr + Dy at % | Nd at % | Pr at % | Dy at % | B at % | Co at % | Cu at % | Fe at % |
| R Alloy 3 | 27.26 | 24.41 | 0.02 | 2.83 | 5.76 | 0 | 0 | 66.98 |
| R Alloy 4 | 14.52 | 11.64 | 0.02 | 2.86 | 0 | 4.3 | 0.35 | 80.83 |

TABLE 3

| | Composition and Thickness of Starting Material Alloy used for Single Alloy Method | | | | | | | | |
|---|---|---|---|---|---|---|---|---|---|
| | Composition | | | | | | | | Thickens |
| | Nd + Pr + Dy at % | Nd At % | Pr at % | Dy at % | B at % | Co at % | Cu at % | Fe at % | of Alloy mm |
| Comparative Example 6 | 14.18 | 11.14 | 0.01 | 3.03 | 6.18 | 0.58 | 0.05 | 79.01 | 0.35 |

TABLE 4

| | Magnetic Properties and Approximate Grain Size of Sintered Magnet | | | | | |
|---|---|---|---|---|---|---|
| | Magnet Properties | | | | | |
| | Sintering Temperature ° C. | Sintering Density g/cm$^3$ | Br KG | iHc kOe | (BH) max MGOe | Grain Size ($\mu$m) |
| Example 5 | 1060 | 7.52 | 12.0 | 27.8 | 35.5 | 10~15 |
| Example 6 | 1060 | 7.51 | 11.8 | 27.6 | 34.4 | 10~15 |
| Example 6 | 1100 | 7.57 | 12.1 | 26.5 | 35.0 | 15~20 |
| Example 7 | 1060 | 7.52 | 12.0 | 27.2 | 34.2 | 15~20 |
| Example 7 | 1100 | 7.57 | 12.2 | 26.3 | 35.1 | 10~15 |
| Example 8 | 1060 | 7.52 | 11.8 | 26.7 | 33.6 | 15~20 |
| Example 8 | 1100 | 7.58 | 12.0 | 25.8 | 34.5 | 15~20 |
| Comparative Example 6 | 1060 | 7.51 | 12.0 | 27.2 | 35.1 | Number of coarse grains ϕ 0.1~ϕ 0.5 mm |
| Comparative Example 6 | 1100 | 7.58 | 11.7 | 23.7 | 29.8 | 15~20 |
| Comparative Example 7 | 1060 | 7.52 | 10.1 | 30 | 24.4 | 15~20 |
| Comparative Example 8 | 1060 | 7.52 | 11.2 | 27.0 | 30.1 | 15~20 |
| Comparative Example 9 | 1060 | 7.52 | 12.3 | 8.9 | 16.4 | 10~15 |

Comparative Example 10

The boundary-phase alloy "R Alloy 4" described in Table 2 was cast under the same conditions as in Example 2.

Observation by SEM diffraction electron image and EDX analysis of this alloy's cross-section revealed that a number of α Fe phase was formed. Optional ten locations of the alloys cross-section were selected for photographing by diffraction electron photo, and the formation region of the α Fe phase was quantitatively analyzed by an image processing apparatus. The formation region of the α Fe phase was 38 % volume.

Example 9

The green compact, which was manufactured in Example 6 and shaped under the magnetic field in Example 9, was allowed to stand in ambient air. The change of oxygen was measured. The results are shown in Table 5.

Comparative Example 11

Mixed fine powder was prepared by using the main-phase alloy of Comparative Example 1 and R Alloy 2 by the same method as in Example 5. The blending weight proportion was 83:17 so that almost no B-rich phase was present in the composition after sintering and manufacture of magnet. The resultant mixed fine powder had 3.4 $\mu$m (FSSS) of average particle size.

Shaping in the magnetic field was carried out by the same methods as in Example 5. The change in oxygen concentration change of this green compact was measured. The result is described in Table 5. It turns out that the green compact is easily oxidized as compared with Example 9.

Comparative Example 12

The green compact, which was manufactured in Comparative Example 6 and shaped in the magnetic field in Example 9, was allowed to stand in ambient air. The change of oxygen was measured. The results are shown in Table 5. It turns out that the green compact is easily oxidized as compared with Example 9.

TABLE 5

Standing Time in Ambient Air and Oxygen Concentration of Green Compacts after shaping in Magnetic Field

| | Standing Time in Air | |
|---|---|---|
| | 0 hour | 6 hour |
| Example 9 | 3000 ppm | 3800 ppm |
| Comparative Example 11 | 3000 ppm | 6900 ppm |
| Comparative Example 12 | 3000 ppm | 6100 ppm |

Industrial Applicability

As is explained hereinabove, the dendritic α Fe phase is formed in the sintered alloy, the volume ratio of the $R_2T_{14}B$ phase of which is high, and it impairs the magnetic properties. However, improved magnetic properties are obtained by using the raw material alloy provided by the present invention for producing R—T—B based sintered magnet according to the present invention.

What is claimed is:

1. Main phase alloy used for producing an R—T—B sintered magnet, comprising $R_2T_{14}B$, where R is at least one selected from rare-earth elements including Y, T is Fe, part of which is replaceable with at least one of Co and Ni, and B is boron, part of which is replaceable with at least one of C and N, made by a two-alloy mixing method of mixing main phase alloy and boundary-phase alloy, wherein said main phase alloy having a composition comprising 10 to 11.8 at % of a rare earth element consisting of 1 to 6 at % of Dy based on said main phase alloy and the balance at least one of Nd and Pr, 5.88 to 8.00 at % of B, and the balance of T;

wherein said main phase alloy having a structure consisting of a first region, a second region and a matrix of $R_2T_{14}B$ phase other than the first region and the second region, said first region having a dendritic α Fe phase dispersed in the matrix of $R_2T_{14}B$ phase, said second region having a lamellar α Fe phase dispersed in the matrix of $R_2T_{14}B$ phase, said first region having the dendritic α Fe phase occupying 0 to 10 vol % of the main phase alloy, and said second region having the lamellar α Fe phase occupying not less than 5 vol % of the main phase alloy.

2. The main phase alloy according to claim 1, wherein the first region having the dendritic α Fe phase occupies 0 vol % of the main phase alloy.

3. The main phase alloy according to claim 1, wherein it is produced by a strip casting method and has an average thickness of 0.1 to 0.5 mm.

4. The main phase alloy according to claim 1, wherein there is no lamellar R rich phase having an R content larger than $R_2T_{14}B$ phase.

5. Alloy used for producing an R—T—B sintered magnet, consisting of a mixture of not less than 60 wt % of the main phase alloy according to claim 1, and less than 40 wt % of a boundary-phase alloy comprising not less than 15 at % of at least one of Dy, Nd and Pr, and the balance of T, where T is Fe, part of which is replaceable with at least one of Co and Ni.

6. The alloy according to claim 5, wherein the boundary-phase alloy further contains not more than 1 wt % of B.

7. The alloy according to claim 5, wherein the boundary-phase alloy further comprises not less than 1 at % of Co.

8. A method of producing an R—T—B sintered magnet, wherein it comprises the steps of pulverizing the alloy according to claim 5, shaping the pulverized alloy in a magnetic field, and sintering the shaped alloy.

* * * * *